US012510276B2

(12) United States Patent
Wada

(10) Patent No.: US 12,510,276 B2
(45) Date of Patent: Dec. 30, 2025

(54) AIR-CONDITIONING APPARATUS

(71) Applicant: Mitsubishi Electric Corporation, Tokyo (JP)

(72) Inventor: Nobuhiro Wada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 181 days.

(21) Appl. No.: 18/555,984

(22) PCT Filed: Jul. 7, 2021

(86) PCT No.: PCT/JP2021/025579
§ 371 (c)(1),
(2) Date: Oct. 18, 2023

(87) PCT Pub. No.: WO2023/281646
PCT Pub. Date: Jan. 12, 2023

(65) Prior Publication Data
US 2024/0200843 A1 Jun. 20, 2024

(51) Int. Cl.
*F25B 49/02* (2006.01)

(52) U.S. Cl.
CPC ..... *F25B 49/02* (2013.01)

(58) Field of Classification Search
CPC ..... F25B 49/02
USPC ..... 62/228.1
See application file for complete search history.

(56) References Cited

U.S. PATENT DOCUMENTS

| | | | | |
|---|---|---|---|---|
| 10,088,205 | B2 | 10/2018 | Yamashita | |
| 2020/0248943 | A1 | 8/2020 | Nishio et al. | |
| 2022/0205662 | A1 * | 6/2022 | Ishimura | F24F 11/48 |

FOREIGN PATENT DOCUMENTS

| | | | | |
|---|---|---|---|---|
| JP | H05-118720 | A | 5/1993 | |
| JP | 2000-097527 | A | 4/2000 | |
| JP | 2020134059 | A | 8/2020 | |
| WO | WO-2023281646 | A1 * | 1/2023 | F24F 11/36 |

OTHER PUBLICATIONS

Wada, Air-Conditioning Device, 2021, Full Document (Year: 2021).*
Extended European Search Report dated Jul. 16, 2024 issued in corresponding European patent application No. 21949280.8.
International Search Report of the International Searching Authority mailed Aug. 10, 2021 in corresponding International Application No. PCT/JP2021/025579 (and English translation).

* cited by examiner

*Primary Examiner* — Nael N Babaa
(74) *Attorney, Agent, or Firm* — Posz Law Group, PLC

(57) ABSTRACT

An air-conditioning apparatus includes a refrigerant circuit including a compressor, a heat-source-side heat exchanger, an expansion device, a load-side heat exchanger, and a shut-off valve connected in sequence by pipes to allow refrigerant to flow therethrough; a heat-source-side air-sending device configured to send air to the heat-source-side heat exchanger; a leakage detecting unit configured to detect refrigerant leakage; and a controller configured to perform cooling operation. The controller is configured to, if the leakage detecting unit detects refrigerant leakage during cooling operation, close the shut-off valve after lowering an operation frequency of the compressor and increasing a rotation speed of the heat-source-side air-sending device.

15 Claims, 7 Drawing Sheets

AIR-CONDITIONING APPARATUS

CROSS REFERENCE TO RELATED APPLICATION

This application is a U.S. national stage application of PCT/JP2021/025579 filed on Jul. 7, 2021, the contents of which are incorporated herein by reference.

TECHNICAL FIELD

The present disclosure relates to an air-conditioning apparatus used, for example, as a variable refrigerant flow (VRF) system.

BACKGROUND ART

Conventionally, in an air-conditioning apparatus, such as a VRF system, for example, an outdoor unit installed outside the building and serving as a heat source unit and an indoor unit installed inside the building are connected by pipes to form a refrigerant circuit which circulates a refrigerant. A space to be air-conditioned is heated or cooled by heating or cooling air using a refrigerant capable of transferring and receiving heat. Recently, from the perspective of global warming, the refrigerant circulating in the refrigerant circuit has been required to be shifted to a refrigerant having a lower global warming potential. However, refrigerants having low global warming potentials are often flammable. If a shift to such refrigerants having low global warming potentials proceeds, more consideration is to be given to safety. To address such an issue, a technique has been proposed in which a refrigerant circuit has a shut-off valve for blocking the flow of refrigerant, so that even if the refrigerant leaks, the amount of refrigerant leakage is reduced (see, e.g., Patent Literature 1).

A refrigeration apparatus proposed in Patent Literature 1 includes a leakage detecting device configured to detect refrigerant leakage, and shut-off valves provided in both a liquid pipe and a gas pipe that connect an indoor unit and an outdoor unit. If the leakage detecting device detects leakage of refrigerant, both the shut-off valves are closed, or one of the shut-off valves is closed first and the other shut-off valve is closed after completion of a refrigerant recovery operation. Thus, even in the event of refrigerant leakage, the level of oxygen in the room can be maintained, and fluorocarbon refrigerant can be prevented from being released into the atmosphere.

CITATION LIST

Patent Literature

Patent Literature 1: Japanese Unexamined Patent Application Publication No. 5-118720

SUMMARY OF INVENTION

Technical Problem

In the related art described in Patent Literature 1, the shut-off valves are closed in the event of leakage of flammable refrigerant. A problem has been that abrupt closure of the shut-off valves causes a liquid hammer phenomenon and leads to failure of the shut-off valves.

The present disclosure has been made to solve the problem described above. An object of the present disclosure is to provide an air-conditioning apparatus that can reduce failure of shut-off valves.

Solution to Problem

An air-conditioning apparatus of one embodiment of the present disclosure includes a refrigerant circuit including a compressor, a heat-source-side heat exchanger, an expansion device, a load-side heat exchanger, and a shut-off valve connected in sequence by pipes to allow refrigerant to flow therethrough; a heat-source-side air-sending device configured to send air to the heat-source-side heat exchanger; a leakage detecting unit configured to detect refrigerant leakage; and a controller configured to perform cooling operation. The controller is configured to, if the leakage detecting unit detects refrigerant leakage during cooling operation, close the shut-off valve after lowering an operation frequency of the compressor and increasing a rotation speed of the heat-source-side air-sending device.

An air-conditioning apparatus of another embodiment of the present disclosure includes a refrigerant circuit including a compressor, a heat-source-side heat exchanger, an expansion device, a heat medium heat exchanger, and a shut-off valve connected in sequence by pipes to allow refrigerant to flow therethrough; a heat medium circuit including a pump, the heat medium heat exchanger, a heat medium flow control device, and a load-side heat exchanger connected in sequence by pipes to allow a heat medium to flow therethrough; a heat-source-side air-sending device configured to send air to the heat-source-side heat exchanger; a leakage detecting unit configured to detect refrigerant leakage; and a controller configured to perform cooling operation. The controller is configured to, if the leakage detecting unit detects refrigerant leakage during cooling operation, close the shut-off valve after lowering an operation frequency of the compressor and increasing a rotation speed of the heat-source-side air-sending device.

Advantageous Effects of Invention

If refrigerant leakage is detected during cooling operation, the air-conditioning apparatus according to an embodiment of the present disclosure lowers the frequency of the compressor, so that the pressure of the refrigerant circuit can be prevented from becoming too high when the shut-off valve is closed to shut off the flow of refrigerant. Also, increasing the rotation speed of the heat-source-side air-sending device facilitates condensation of the refrigerant in the heat-source-side heat exchanger and can suppress an increase in the discharge pressure of the compressor. This reduces a pressure difference during operation of the shut-off valve, makes the occurrence of a liquid hammer phenomenon less likely, and can reduce failure of the shut-off valve.

DESCRIPTION OF EMBODIMENTS

Figure 1:
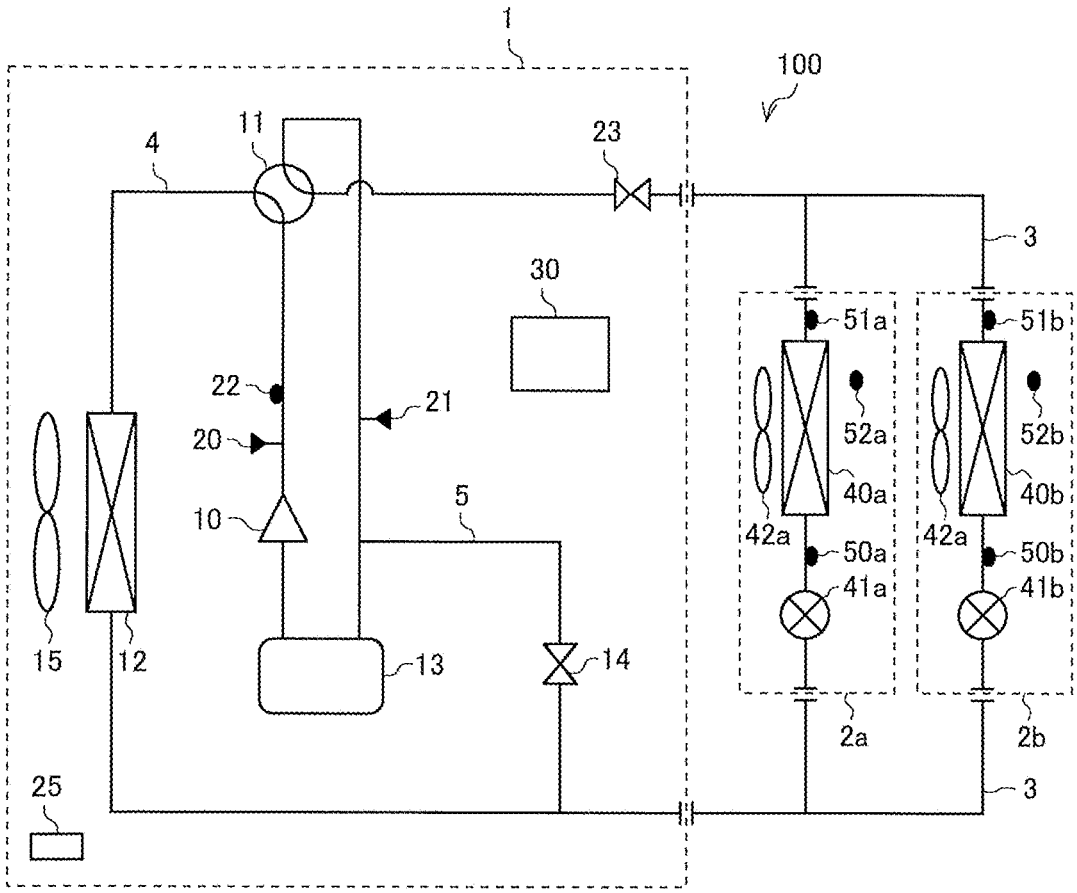
FIG. 1 is a refrigerant circuit diagram illustrating an example of an air-conditioning apparatus according to Embodiment 1.

Embodiments 1 and 2 of the present disclosure will now be described on the basis of the drawings. Note that the present disclosure is not limited by Embodiments 1 and 2 described below. Also, dimensional relations between components illustrated in the drawings may differ from actual ones.

Embodiment 1

FIG. 1 is a refrigerant circuit diagram illustrating an example of an air-conditioning apparatus 100 according to Embodiment 1.

Hereinafter, a configuration of the air-conditioning apparatus 100 according to Embodiment 1 will be described on the basis of FIG. 1.

The air-conditioning apparatus 100 circulates refrigerant in the refrigerant circuit to perform air-conditioning using a refrigeration cycle. For example, like a VRF system, the air-conditioning apparatus 100 is capable of selecting a cooling only operation in which all operating indoor units perform cooling, or a heating only operation in which all operating indoor units perform heating.

The air-conditioning apparatus 100 includes one outdoor unit 1 and two indoor units 2*a* and 2*b*. The outdoor unit 1 and the indoor units 2*a* and 2*b* are connected by a refrigerant main pipe 3. Although there are one outdoor unit 1 and two indoor units 2*a* and 2*b* in Embodiment 1 as illustrated in FIG. 1, the configuration is not limited to this. There may be two or more outdoor units 1, and there may be one indoor unit or three or more indoor units, instead of the indoor units 2*a* and 2*b* described above.

The air-conditioning apparatus 100 includes a refrigerant circuit through which a refrigerant flows. The refrigerant circuit includes a compressor 10, a refrigerant flow switching device 11, a heat-source-side heat exchanger 12, expansion devices 41*a* and 41*b*, a load-side heat exchangers 40*a* and 40*b*, a shut-off valve 23, and an accumulator 13 that are connected in sequence by pipes including the refrigerant main pipe 3 and a refrigerant pipe 4.

[Outdoor Unit 1]

The outdoor unit 1 includes the compressor 10, the refrigerant flow switching device 11, the heat-source-side heat exchanger 12, and the accumulator 13. A heat-source-side air-sending device 15 constituted, for example, by a fan is disposed near the heat-source-side heat exchanger 12. The heat-source-side air-sending device 15 is configured to send air to the heat-source-side heat exchanger 12. The compressor 10, the refrigerant flow switching device 11, the heat-source-side heat exchanger 12, and the accumulator 13 are connected by the refrigerant pipe 4.

The compressor 10 is configured to suction a low-temperature and low-pressure refrigerant and compress the refrigerant to a high-temperature and high-pressure state. For example, the compressor 10 may be constituted by a capacity-controllable inverter compressor. The refrigerant flow switching device 11 may be, for example, a four-way valve and is configured to switch between the flow of refrigerant in cooling operation and the flow of refrigerant in heating operation.

The heat-source-side heat exchanger 12 functions as a condenser during cooling operation and functions as an evaporator during heating operation. The heat-source-side heat exchanger 12 is configured to exchange heat between air supplied from the heat-source-side air-sending device 15 and the refrigerant.

The accumulator 13 is disposed on the suction side of the compressor 10. The accumulator 13 is configured to store excess refrigerant generated by a difference in operating state between the cooling operation and the heating operation, or excess refrigerant generated by transient changes in operation.

The outdoor unit 1 also includes a heat-source-side bypass pipe 5 branching off from a passage between the heat-source-side heat exchanger 12 and the expansion devices 41*a* and 41*b* and joining a passage between the accumulator 13 and the load-side heat exchangers 40*a* and 40*b* during cooling operation, and a heat-source-side bypass opening and closing device 14 disposed in the heat-source-side bypass pipe 5. The heat-source-side bypass opening and closing device 14 is configured to shut off the flow of refrigerant in the heat-source-side bypass pipe 5. The heat-source-side bypass opening and closing device 14 may be any device capable of shutting off the flow of refrigerant, and may be constituted, for example, by a solenoid valve.

The outdoor unit 1 also includes the shut-off valve 23 disposed in the refrigerant pipe 4 that connects the refrigerant flow switching device 11 to the refrigerant main pipe 3 on the side of the load-side heat exchangers 40*a* and 40*b*. The shut-off valve 23 is configured to shut off the flow of refrigerant in the refrigerant pipe 4. The shut-off valve 23 may be any device capable of shutting off the flow of refrigerant, and may be constituted, for example, by a solenoid valve.

The outdoor unit 1 also includes a first pressure detecting device 20 and a second pressure detecting device 21. The first pressure detecting device 20 is disposed in the refrigerant pipe 4 connecting the discharge side of the compressor 10 to the refrigerant flow switching device 11, and is configured to detect the pressure of the refrigerant compressed by the compressor 10 to a high-temperature and high-pressure state and discharged from the compressor 10. The second pressure detecting device 21 is disposed in the refrigerant pipe 4 connecting the refrigerant flow switching device 11 to the suction side of the compressor 10, and is configured to detect the pressure of low-temperature and low-pressure refrigerant suctioned into the compressor 10. The first pressure detecting device 20 and the second pressure detecting device 21 are, for example, pressure sensors.

The outdoor unit 1 also includes a first temperature detecting device 22. The first temperature detecting device 22 is disposed in the refrigerant pipe 4 connecting the discharge side of the compressor 10 to the refrigerant flow switching device 11, and is configured to detect the temperature (hereinafter referred to as discharge temperature) of the refrigerant compressed by the compressor 10 to a high-temperature and high-pressure state and discharged from the compressor 10. The first temperature detecting device 22 is, for example, a thermistor.

[Indoor Units 2*a* and 2*b*]

The indoor units 2*a* and 2*b* include the load-side heat exchangers 40*a* and 40*b*, respectively, and the expansion devices 41*a* and 41*b*, respectively. Load-side air-sending devices 42*a* and 42*b* each constituted, for example, by a fan are disposed near the load-side heat exchangers 40*a* and 40*b*, respectively. The load-side air-sending devices 42*a* and 42*b* send air to the load-side heat exchangers 40*a* and 40*b*, respectively. The indoor units 2*a* and 2*b* are connected to the outdoor unit 1 by the refrigerant main pipe 3, through which the refrigerant flows in and out of the indoor units 2*a* and 2*b*. The load-side heat exchangers 40*a* and 40*b* are configured to exchange heat between air supplied from the load-side air-sending devices 42*a* and 42*b* and the refrigerant and generate heating air or cooling air to be supplied to an indoor space. The expansion devices 41*a* and 41*b* have the function of a pressure reducing valve or an expansion valve, and are configured to reduce the pressure of, and expand, the refrigerant. The expansion devices 41*a* and 41*b* may each be constituted by a device whose opening degree is variably controllable, such as an electronic expansion valve.

The indoor units 2*a* and 2*b* include second temperature detecting devices 50*a* and 50*b*, respectively, third temperature detecting devices 51*a* and 51*b*, respectively, and fourth temperature detecting devices 52*a* and 52*b*, respectively. The second temperature detecting devices 50*a* and 50*b* are disposed in respective refrigerant pipes (not shown) connecting the expansion devices 41*a* and 41*b* to the load-side heat exchangers 40*a* and 40*b*, and are each configured to detect the temperature of the refrigerant flowing into a corresponding one of the load-side heat exchangers 40*a* and 40*b* during cooling operation. The third temperature detecting devices 51*a* and 51*b* are disposed in respective refrigerant pipes (not shown) opposite the expansion devices 41*a* and 41*b*, with the load-side heat exchangers 40*a* and 40*b* therebetween, and are each configured to detect the temperature of the refrigerant flowing out of a corresponding one of the load-side heat exchangers 40*a* and 40*b* during cooling operation. The fourth temperature detecting devices 52*a* and 52*b* are disposed in respective air inlets (not shown) of the load-side heat exchangers 40*a* and 40*b* and configured to detect the temperature of indoor air. The second temperature detecting devices 50*a* and 50*b*, the third temperature detecting devices 51*a* and 51*b*, and the fourth temperature detecting devices 52*a* and 52*b* are, for example, thermistors.

Hereinafter, the indoor units 2*a* and 2*b*, the load-side heat exchangers 40*a* and 40*b*, the expansion devices 41*a* and 41*b*, and the load-side air-sending devices 42*a* and 42*b* will be collectively referred to as an indoor unit 2, a load-side heat exchanger 40, an expansion device 41, and a load-side air-sending device 42, respectively. Also, the second temperature detecting devices 50*a* and 50*b*, the third temperature detecting devices 51*a* and 51*b*, and the fourth temperature detecting devices 52*a* and 52*b* will be collectively referred to as a second temperature detecting device 50, a third temperature detecting device 51, and a fourth temperature detecting device 52, respectively.

As a leakage detecting unit that detects leakage of the refrigerant, the air-conditioning apparatus 100 includes a leakage detecting device 25 which is an electrical gas sensor, such as a semiconductor gas sensor or a hot-wire semiconductor gas sensor. Although the leakage detecting device 25 is included in the outdoor unit 1 in Embodiment 1 as illustrated in FIG. 1, the configuration is not limited to this. The leakage detecting device 25 may be included in the indoor unit 2, or may be included in each of the outdoor unit 1 and the indoor unit 2.

The air-conditioning apparatus 100 also includes a controller 30 constituted, for example, by a microcomputer. The controller 30 has a refrigerant leakage prevention function that detects the occurrence of refrigerant leakage on the basis of a detection value of the leakage detecting device 25 and activates the shut-off valve 23 in the event of refrigerant leakage. Instead of detecting the occurrence of refrigerant leakage on the basis of a detection value of the leakage detecting device 25, the controller 30 may detect refrigerant leakage from detection values of various detecting devices included in the air-conditioning apparatus 100, other than the leakage detecting device 25.

On the basis of detection values of various detecting devices and instructions from a remote control unit, the controller 30 controls, for example, the frequency of the compressor 10, the rotation speed of the heat-source-side air-sending device 15 (including the ON/OFF of the heat-source-side air-sending device 15) for the heat-source-side heat exchanger 12, the switching of the refrigerant flow switching device 11, and the opening degree of the expansion device 41 and performs each of operations described below. Although the controller 30 is included in the outdoor unit 1 in Embodiment 1 as illustrated in FIG. 1, the configuration is not limited to this. The controller 30 may be included in the indoor unit 2, or may be included in each of the outdoor unit 1 and the indoor unit 2.

[Cooling Operation]

Figure 2:
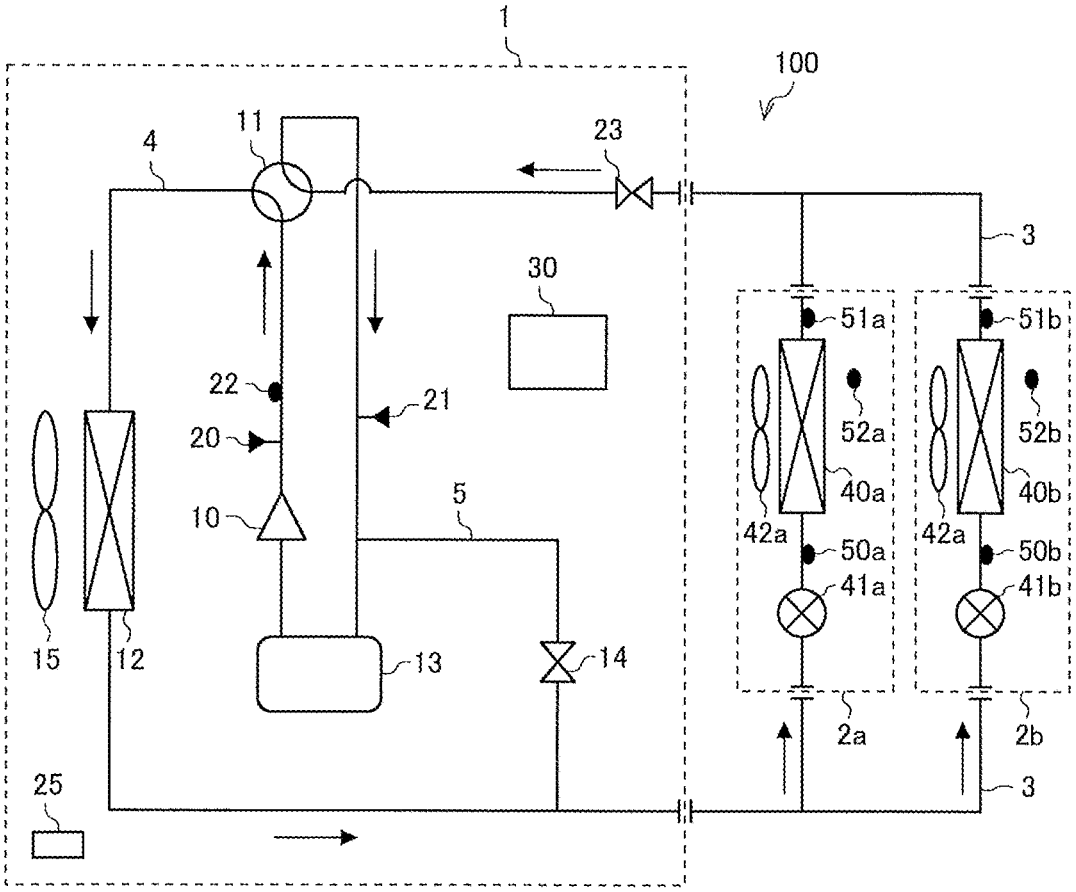
FIG. 2 is a refrigerant circuit diagram illustrating the flow of refrigerant in cooling operation of the air-conditioning apparatus according to Embodiment 1.

FIG. 2 is a refrigerant circuit diagram illustrating the flow of refrigerant in cooling operation of the air-conditioning apparatus 100 according to Embodiment 1. In FIG. 2, a refrigerant flow direction is indicted by a solid arrow.

On the basis of FIG. 2, a cooling operation of the air-conditioning apparatus 100 according to Embodiment 1 will be described by taking, as an example, the case where cooling load is generated in the load-side heat exchanger 40.

In cooling operation, the refrigerant flow switching device 11 is switched to allow refrigerant discharged from the compressor 10 to flow into the heat-source-side heat exchanger 12. A low-temperature and low-pressure refrigerant is compressed by the compressor 10 to a high-temperature and high-pressure gas refrigerant and discharged. The high-temperature and high-pressure gas refrigerant discharged from the compressor 10 passes through the refrigerant flow switching device 11 and flows into the heat-source-side heat exchanger 12. After flowing into the heat-source-side heat exchanger 12, the high-temperature and high-pressure gas refrigerant condenses to a high-pressure liquid refrigerant while transferring heat to outdoor air. After flowing out of the heat-source-side heat exchanger 12, the high-pressure liquid refrigerant flows out of the outdoor unit 1, passes through the refrigerant main pipe 3, and flows into the indoor unit 2. The heat-source-side bypass opening and closing device 14 is closed to prevent the refrigerant from taking a detour inside the outdoor unit 1.

When the heat-source-side bypass opening and closing device 14 is not an opening degree adjustable device, such as a solenoid valve, the heat-source-side bypass opening and closing device 14 may be closed during cooling operation, whereas when the heat-source-side bypass opening and closing device 14 is an opening degree adjustable device, such as an electronic expansion valve, the heat-source-side bypass opening and closing device 14 may be set to an opening degree (e.g., a fully-closed position or an opening degree close to it) that does not negatively affect the operating state (e.g., cooling capacity) of the refrigeration cycle during cooling operation.

After flowing into the indoor unit 2, the high-pressure liquid refrigerant is reduced in pressure by the expansion device 41 to a low-temperature and low-pressure two-phase refrigerant, flows into the load-side heat exchanger 40 acting as an evaporator, receives heat from indoor air to cool the indoor air, and turns into a low-temperature and low-pressure gas refrigerant. After flowing out of the load-side heat exchanger 40, the low-temperature and low-pressure gas refrigerant passes through the refrigerant main pipe 3 and flows into the outdoor unit 1. After flowing into the outdoor unit 1, the refrigerant passes through the refrigerant flow switching device 11 and the accumulator 13 and is suctioned into the compressor 10.

The controller 30 controls the opening degree of the expansion device 41 in such a way as to maintain constant superheat (degree of superheat), which is obtained as a difference between the temperature detected by the second temperature detecting device 50 and the temperature detected by the third temperature detecting device 51. The level of performance can thus be adjusted for indoor thermal load and this enables efficient operation.

[Heating Operation]

Figure 3:
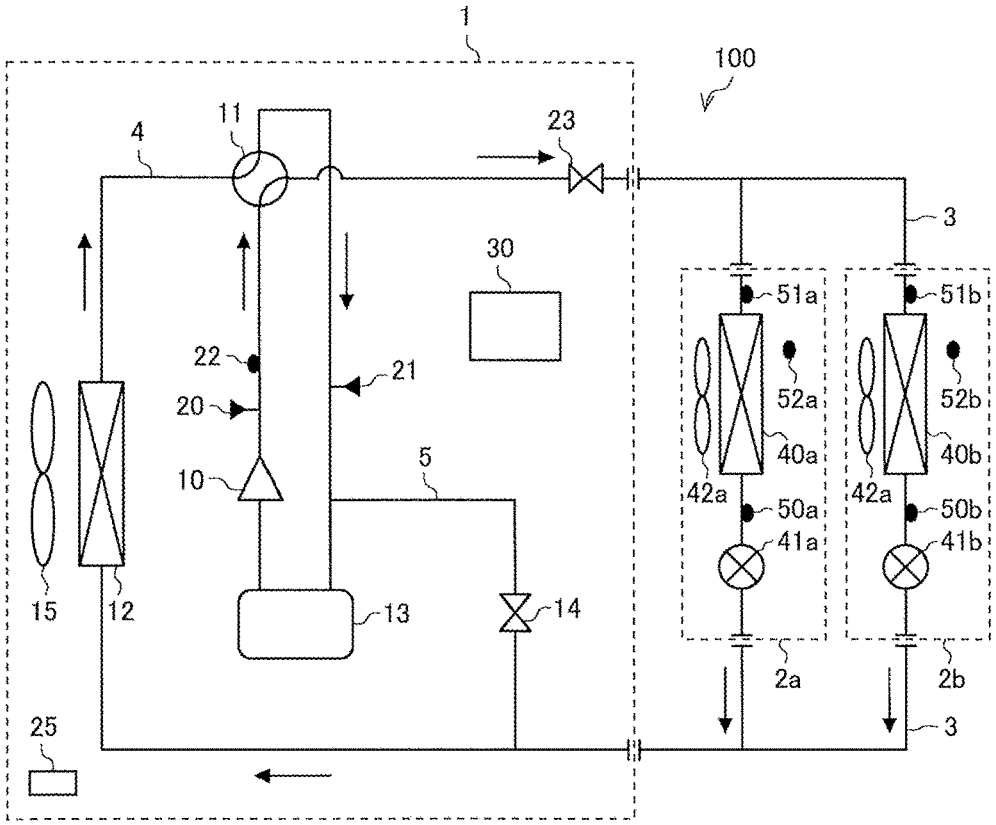
FIG. 3 is a refrigerant circuit diagram illustrating the flow of refrigerant in heating operation of the air-conditioning apparatus according to Embodiment 1.

FIG. 3 is a refrigerant circuit diagram illustrating the flow of refrigerant in heating operation of the air-conditioning apparatus 100 according to Embodiment 1. In FIG. 3, a refrigerant flow direction is indicted by a solid arrow.

On the basis of FIG. 3, a heating operation of the air-conditioning apparatus 100 according to Embodiment 1 will be described by taking, as an example, the case where heating load is generated in the load-side heat exchanger 40.

In heating operation, the refrigerant flow switching device 11 is switched to allow refrigerant discharged from the compressor 10 to flow into the load-side heat exchanger 40. A low-temperature and low-pressure refrigerant is compressed by the compressor 10 to a high-temperature and high-pressure gas refrigerant and discharged. The high-temperature and high-pressure gas refrigerant discharged from the compressor 10 passes through the refrigerant flow switching device 11 and flows through the refrigerant main pipe 3 into the indoor unit 2. After flowing into the indoor unit 2, the high-temperature and high-pressure gas refrigerant flows into the load-side heat exchanger 40, transfers heat to indoor air, turns into a high-pressure liquid refrigerant, and flows into the expansion device 41. The high-pressure liquid refrigerant is reduced in pressure by the expansion device 41 to a low-temperature and low-pressure two-phase refrigerant, flows out of the indoor unit 2, passes through the refrigerant main pipe 3, and flows into the outdoor unit 1. The heat-source-side bypass opening and closing device 14 is closed to prevent the refrigerant from taking a detour inside the outdoor unit 1.

When the heat-source-side bypass opening and closing device 14 is not an opening degree adjustable device, such as a solenoid valve, the heat-source-side bypass opening and closing device 14 may be closed during heating operation, whereas when the heat-source-side bypass opening and closing device 14 is an opening degree adjustable device, such as an electronic expansion valve, the heat-source-side bypass opening and closing device 14 may be set to an opening degree (e.g., a fully-closed position or an opening degree close to it) that does not negatively affect the operating state (e.g., heating capacity) of the refrigeration cycle during heating operation.

After flowing into the outdoor unit 1, the low-temperature and low-pressure two-phase refrigerant flows into the heat-source-side heat exchanger 12 and receives heat from outdoor air to turn into a low-temperature and low-pressure gas refrigerant. After flowing out of the heat-source-side heat exchanger 12, the low-temperature and low-pressure gas refrigerant passes through the refrigerant flow switching device 11 and the accumulator 13 and is suctioned into the compressor 10.

The controller 30 controls the opening degree of the expansion device 41 in such a way as to maintain constant subcooling (degree of subcooling), which is obtained as a difference between the saturated liquid temperature of refrigerant calculated from the pressure detected by the first pressure detecting device 20 and the temperature detected by the second temperature detecting device 50. The level of performance can thus be adjusted for indoor thermal load and this enables efficient operation.

Next, a liquid hammer prevention control action of the air-conditioning apparatus 100 according to Embodiment 1 will be described.

The liquid hammer prevention control action is a function of the controller 30 and is a control action started when the leakage detecting device 25 detects the occurrence of refrigerant leakage. In Embodiment 1, an example has been described in which, as a leakage detecting unit that detects leakage of refrigerant, the leakage detecting device 25 is used to detect the occurrence of refrigerant leakage. However, the configuration is not limited to this. Any leakage detecting unit may be used as long as it is capable of detecting the occurrence of refrigerant leakage and acting as a trigger for starting a control action. For example, the first temperature detecting device 22 may be used as the leakage detecting unit. In this case, the occurrence of refrigerant leakage is detected if the discharge temperature of the compressor 10 exceeds a preset threshold without change in the cooling load of the load-side heat exchanger 40.

Figure 4:
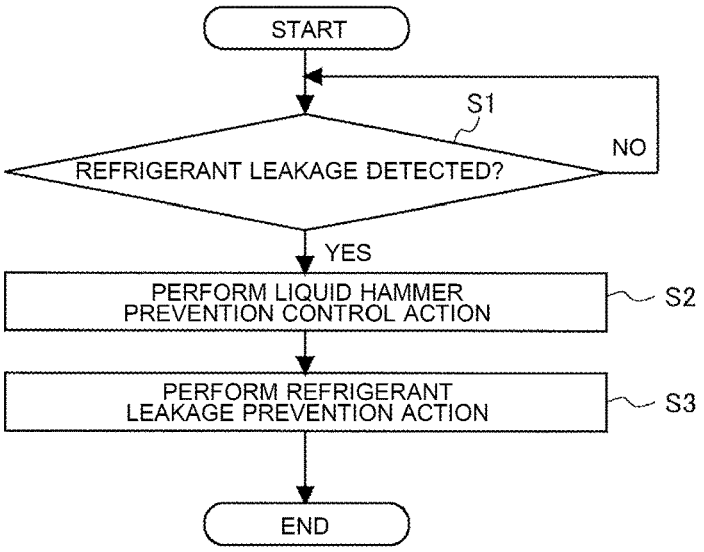
FIG. 4 is a flowchart illustrating a refrigerant leakage prevention action of the air-conditioning apparatus according to Embodiment 1.

FIG. 4 is a flowchart illustrating a refrigerant leakage prevention action of the air-conditioning apparatus 100 according to Embodiment 1.

On the basis of FIG. 4, a refrigerant leakage prevention action of the air-conditioning apparatus 100 according to Embodiment 1 will be described.

(Step S1)

The controller 30 determines whether the occurrence of refrigerant leakage has been detected. If the controller 30 determines that the occurrence of refrigerant leakage has been detected (YES), the process proceeds to step S2. On the other hand, if the controller 30 determines that the occurrence of refrigerant leakage has not been detected (NO), the operation of step S1 is repeated. Here, the occurrence of refrigerant leakage means that LFL/4 (LFL: lower explosion limit), which is a reference value used to detect refrigerant leakage, or a value less than or equal to the reference value, has been detected using the leakage detecting device 25. The occurrence of refrigerant leakage may be detected by using the first temperature detecting device 22 as described above. That is, the occurrence of refrigerant leakage may be detected when the discharge temperature of the compressor 10 exceeds a threshold without change in the cooling load of the load-side heat exchanger 40.

(Step S2)

The controller 30 performs a liquid hammer prevention control action so as not to cause abrupt change in pressure at shut-off. The process then proceeds to step S3.

(Step S3)

The controller 30 performs a refrigerant leakage prevention action for preventing refrigerant leakage from the point of leakage. Then, the process ends.

Figure 5:
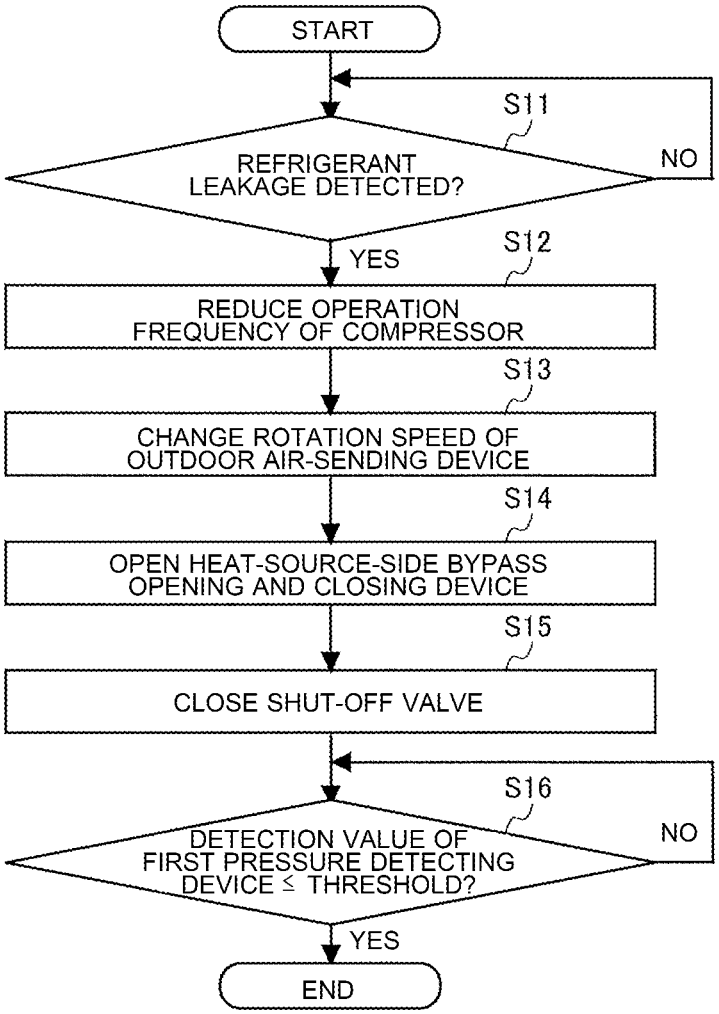
FIG. 5 is a flowchart illustrating details of the refrigerant leakage prevention action of the air-conditioning apparatus according to Embodiment 1.

FIG. 5 is a flowchart illustrating details of the refrigerant leakage prevention action of the air-conditioning apparatus 100 according to Embodiment 1.

On the basis of FIG. 5, the refrigerant leakage prevention action of the air-conditioning apparatus 100 according to Embodiment 1 will be described in detail.

(Step S11)

The controller 30 determines whether the occurrence of refrigerant leakage has been detected. If the controller 30 determines that the occurrence of refrigerant leakage has been detected (YES), the process proceeds to step S12. On the other hand, if the controller 30 determines that the occurrence of refrigerant leakage has not been detected (NO), the operation of step S11 is repeated.

(Step S12)

The controller 30 lowers the operation frequency of the compressor 10. The process then proceeds to step S13.

(Step S13)

The controller 30 changes the rotation speed of the heat-source-side air-sending device 15. The process then proceeds to step S14. Here, the controller 30 increases the rotation speed of the heat-source-side air-sending device 15 in cooling operation, and decreases the rotation speed of the heat-source-side air-sending device 15 in heating operation.

(Step S14)

The controller 30 opens the heat-source-side bypass opening and closing device 14. The process then proceeds to step S15.

(Step S15)

The controller 30 closes the shut-off valve 23. The process then proceeds to step S16.

(Step S16)

The controller 30 determines whether the detection value of the first pressure detecting device 20 has reached a preset threshold. If the controller 30 determines that the detection value of the first pressure detecting device 20 has reached the threshold (YES), the process ends. On the other hand, if the controller 30 determines that the detection value of the first pressure detecting device 20 has not reached the threshold (NO), the operation of step S16 is repeated.

Instead of determining whether the detection value of the first pressure detecting device 20 has reached the threshold in step S16, the controller 30 may determine whether the second pressure detecting device 21 has reached a threshold, or may determine whether a predetermined period of time has passed since the start of the operation of step S12.

Note that steps S12 to S14 in FIG. 5 correspond to the liquid hammer prevention control action illustrated in FIG. 4, and steps S15 and S16 in FIG. 5 correspond to the refrigerant leakage prevention action illustrated in FIG. 4.

In step S12, the operation frequency of the compressor 10 is lowered, as described above. If the operation frequency of the compressor 10 is high when the shut-off valve 23 is closed in step S14, the resulting abrupt change in the pressure of the refrigerant circuit causes the occurrence of a liquid hammer phenomenon. The occurrence of a liquid hammer phenomenon may damage the shut-off valve 23. Therefore, the operation frequency of the compressor 10 may be set lower than that in normal cooling or heating operation, so that the pressure of the refrigerant circuit is prevented from becoming too high when the shut-off valve 23 is closed to shut off the flow of refrigerant.

In step S13, the rotation speed of the heat-source-side air-sending device 15 may be set to a maximum rotation speed or a value close to it in cooling operation, and may be set to a minimum rotation speed or a value close to it in heating operation. Increasing the rotation speed of the heat-source-side air-sending device 15 in cooling operation can facilitate condensation of the refrigerant in the heat-source-side heat exchanger 12 and suppress an increase in the discharge pressure of the compressor 10. Also, increasing the rotation speed of the heat-source-side air-sending device 15 in cooling operation increases subcooling, and decreasing the rotation speed of the heat-source-side air-sending device 15 in heating operation decreases superheat. This facilitates accumulation of liquid refrigerant in the outdoor unit 1, and makes it less likely that a liquid hammer phenomenon will occur.

When the heat-source-side bypass opening and closing device 14 is an opening degree adjustable device, the opening degree may be set to a maximum opening degree in step S14. Opening the heat-source-side bypass opening and closing device 14 reduces the flow rate of the refrigerant flowing through the shut-off valve 23 and makes it less likely that a liquid hammer phenomenon will occur.

The smaller the difference between the pressure detection value on the high-pressure side and the pressure detection value on the low-pressure side, the better. Therefore, when a determination is made in step S16 as to whether the detection value of the first pressure detecting device 20 has reached a threshold, the threshold may be set to a minimum pressure allowed by the compressor 10 during operation or a value close to the minimum pressure. Similarly, when a determination is made as to whether the detection value of the second pressure detecting device 21 has reached a threshold, the threshold may be set to a maximum pressure allowed by the compressor 10 during operation or a value close to the maximum pressure.

The smaller the difference between the pressure on the high-pressure side and the pressure on the low-pressure side, the less the occurrence of a liquid hammer. However, when the operation frequency of the compressor 10 is controlled to be a predetermined target high-pressure value, the pressure on the high-pressure side is not easily lowered. Therefore, when the operation frequency of the compressor 10 is controlled to be a predetermined target high-pressure value, the process is terminated once the detection value of the second pressure detecting device 21, or the pressure detection value on the low-pressure side, reaches the threshold in step S16 (YES in step S16).

As described above, performing the liquid hammer prevention control action (illustrated in FIG. 5) in cooling operation of the air-conditioning apparatus 100 can lower a high pressure in cooling operation. This reduces a pressure difference during operation of the shut-off valve 23 and makes it less likely that a liquid hammer phenomenon will occur.

Although a procedure of the liquid hammer prevention control action according to Embodiment 1 has been described as illustrated in FIG. 5, the procedure is not limited to this. Even when the sequence of step S12 to step S14 is changed, it is still possible to achieve a similar effect.

The liquid hammer prevention control in heating operation makes the pressure of the load-side heat exchanger 40 in the indoor unit 2 very low. As a result, moisture in the air is cooled and the load-side heat exchanger 40 and the refrigerant pipe in the indoor unit 2 may be frozen. This may expand pinholes causing refrigerant leakage in the refrigerant pipe, and may lead to the occurrence of leakage in other areas. Accordingly, the load-side air-sending device 42 is operated at a full speed, or at an airflow rate close to it, to prevent freezing in the indoor unit 2, so that improved safety can be achieved.

Figure 6:
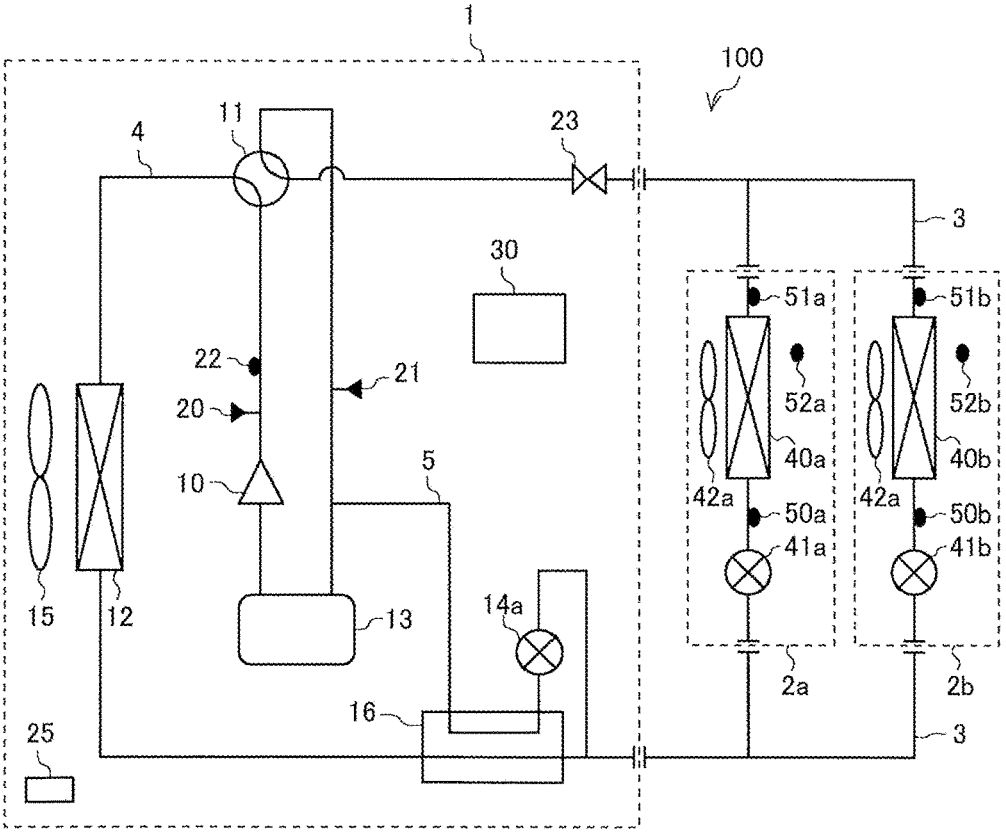
FIG. 6 is a refrigerant circuit diagram illustrating a modification of the air-conditioning apparatus according to Embodiment 1.

FIG. 6 is a refrigerant circuit diagram illustrating a modification of the air-conditioning apparatus 100 according to Embodiment 1.

As illustrated in FIG. 6, the outdoor unit 1 may include an internal heat exchanger 16 for increasing subcooling of the refrigerant flowing out of the outdoor unit 1 during cooling operation. The internal heat exchanger 16 is disposed downstream of the heat-source-side heat exchanger 12 during cooling operation. In this case, the heat-source-side bypass pipe 5 branches off from a passage downstream of the internal heat exchanger 16 during cooling operation, passes through the internal heat exchanger 16, and joins a passage upstream of the accumulator 13. A part of high-pressure liquid refrigerant generated in the heat-source-side heat exchanger 12, mainly during cooling operation, takes a detour to pass through the heat-source-side bypass pipe 5 and is reduced in pressure by the heat-source-side bypass opening and closing device 14 to a low-pressure and low-temperature two-phase refrigerant, which is then subjected to heat exchange in the internal heat exchanger 16. This can increase the degree of subcooling of the refrigerant flowing through the refrigerant main pipe 3. That is, the internal heat exchanger 16 is used to increase the degree of subcooling of the refrigerant flowing through the refrigerant main pipe 3. When the internal heat exchanger 16 is provided, the heat-source-side bypass opening and closing device 14*a* is preferably one whose opening degree is variably controllable, such as an electronic expansion valve, so as to control the degree of subcooling at the outlet of the internal heat exchanger 16.

Although the internal heat exchanger 16 is included in the outdoor unit 1 in FIG. 6, the configuration is not limited to this. The internal heat exchanger 16 may be disposed anywhere between the heat-source-side heat exchanger 12 and the expansion device 41 during cooling operation.

The air-conditioning apparatus 100 according to Embodiment 1 includes the refrigerant circuit including the compressor 10, the heat-source-side heat exchanger 12, the expansion device 41, the load-side heat exchanger 40, and the shut-off valve 23 connected in sequence by pipes to allow refrigerant to flow therethrough; the heat-source-side air-sending device 15 configured to send air to the heat-source-side heat exchanger 12; the leakage detecting unit configured to detect refrigerant leakage; and the controller 30 configured to perform cooling operation. If the leakage detecting unit detects refrigerant leakage during cooling operation, the controller 30 closes the shut-off valve 23 after lowering the operation frequency of the compressor 10 and increasing the rotation speed of the heat-source-side air-sending device 15.

If refrigerant leakage is detected during cooling operation, the air-conditioning apparatus 100 according to Embodiment 1 lowers the operation frequency of the compressor 10, so that the pressure of the refrigerant circuit can be prevented from becoming too high when the shut-off valve 23 is closed to shut off the flow of refrigerant. Also, increasing the rotation speed of the heat-source-side air-sending device 15 facilitates condensation of the refrigerant in the heat-source-side heat exchanger 12 and can suppress an increase in the discharge pressure of the compressor 10. This reduces a pressure difference during operation of the shut-off valve 23, makes the occurrence of a liquid hammer phenomenon less likely, and can reduce failure of the shut-off valve 23.

In the air-conditioning apparatus 100 according to Embodiment 1, the refrigerant circuit includes the refrigerant flow switching device 11 configured to switch the direction of the flow of refrigerant between the cooling operation and the heating operation. If the leakage detecting unit detects refrigerant leakage during heating operation, the controller 30 closes the shut-off valve 23 after lowering the operation frequency of the compressor 10 and decreasing the rotation speed of the heat-source-side air-sending device 15.

If refrigerant leakage is detected during heating operation, the air-conditioning apparatus 100 according to Embodiment 1 lowers the rotation speed of the heat-source-side air-sending device 15 to reduce superheat and facilitate accumulation of liquid refrigerant in the outdoor unit 1, so that a liquid hammer phenomenon is less likely to occur.

The air-conditioning apparatus 100 according to Embodiment 1 includes the load-side air-sending device 42 configured to send air to the load-side heat exchanger 40. If the leakage detecting unit detects refrigerant leakage during heating operation, the controller 30 increases the rotation speed of the load-side air-sending device 42 before closing the shut-off valve 23.

If the leakage detecting unit detects refrigerant leakage during heating operation, the air-conditioning apparatus 100 according to Embodiment 1 increases the rotation speed of the load-side air-sending device 42 before closing the shut-off valve 23. This can prevent freezing in the indoor unit 2 and makes it possible to achieve improved safety.

In the air-conditioning apparatus 100 according to Embodiment 1, the refrigerant circuit includes the heat-source-side bypass pipe 5 branching off from the passage between the heat-source-side heat exchanger 12 and the expansion device 41 and joining the passage between the shut-off valve 23 and the suction side of the compressor 10 during cooling operation, and also includes the heat-source-side bypass opening and closing device 14 disposed in the heat-source-side bypass pipe 5. If the leakage detecting unit detects refrigerant leakage during cooling operation, the controller 30 opens the heat-source-side bypass opening and closing device 14 before closing the shut-off valve 23.

If the leakage detecting unit detects refrigerant leakage during cooling operation, the air-conditioning apparatus 100 according to Embodiment 1 opens the heat-source-side bypass opening and closing device 14 before closing the shut-off valve 23. This reduces the flow rate of the refrigerant flowing through the shut-off valve 23 and makes it less likely that a liquid hammer phenomenon will occur.

Embodiment 2

Embodiment 2 will now be described. Note that the same description as that of Embodiment 1 will be omitted and parts that are the same as, or correspond to, those in Embodiment 1 are assigned the same reference numerals.

Figure 7:
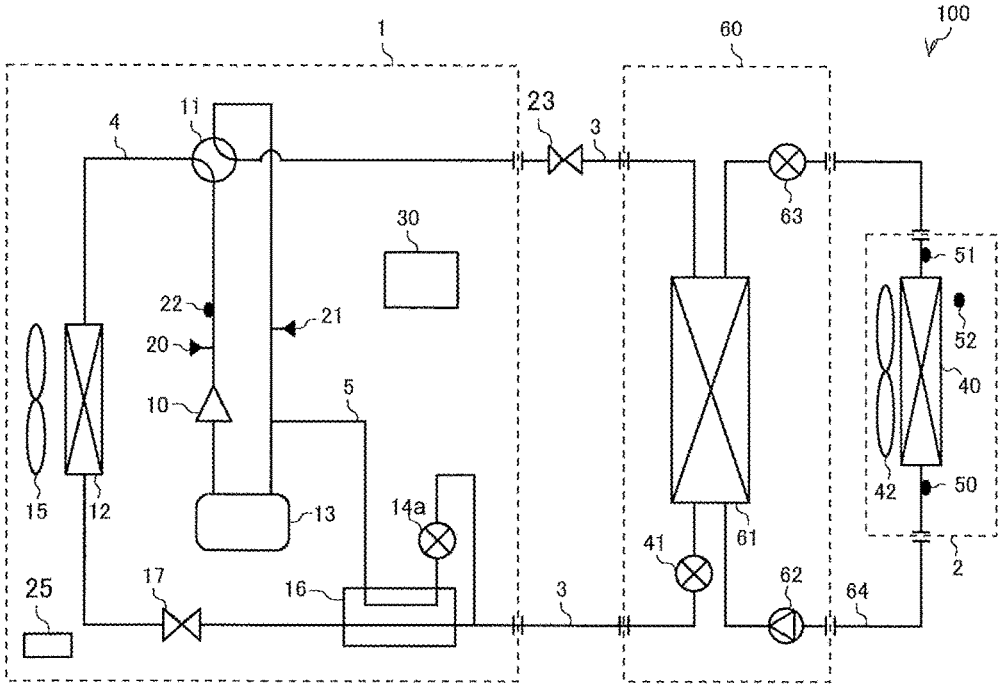
FIG. 7 is a refrigerant circuit diagram illustrating an example of an air-conditioning apparatus according to Embodiment 2.

FIG. 7 is a refrigerant circuit diagram illustrating an example of an air-conditioning apparatus 100 according to Embodiment 2.

The air-conditioning apparatus 100 according to Embodiment 2 includes one outdoor unit 1, one indoor unit 2, and one heat medium relay unit 60. The outdoor unit 1 and the heat medium relay unit 60 are connected by the refrigerant main pipe 3, and the heat medium relay unit 60 and the indoor unit 2 are connected by a heat medium pipe 64.

The air-conditioning apparatus 100 includes a refrigerant circuit in which a refrigerant flows, and a heat medium circuit in which a heat medium flows. The refrigerant circuit includes the compressor 10, the refrigerant flow switching device 11, the heat-source-side heat exchanger 12, the expansion device 41, a heat medium heat exchanger 61, the shut-off valve 23, and the accumulator 13 connected in sequence by pipes including the refrigerant main pipe 3 and the refrigerant pipe 4. The heat medium circuit includes a pump 62, the heat medium heat exchanger 61, a heat medium flow control device 63, and the load-side heat exchanger 40 connected by the heat medium pipe 64.

[Outdoor Unit 1]

The outdoor unit 1 according to Embodiment 2 will not be described here, as it has the same configuration as that according to Embodiment 1.

[Indoor Unit 2]

The indoor unit 2 according to Embodiment 2 will not be described here, as it has the same configuration as that according to Embodiment 1, except that the pipe connecting the components is changed from the refrigerant pipe to the heat medium pipe 64.

[Heat Medium Relay Unit 60]

The heat medium relay unit 60 includes the heat medium heat exchanger 61, the pump 62 configured to convey a heat medium, such as water or brine, and the heat medium flow control device 63 configured to regulate the flow rate of the heat medium flowing inside the heat medium pipe 64. The heat medium heat exchanger 61, the pump 62, and the heat medium flow control device 63 are connected by the heat medium pipe 64 to form the heat medium relay unit 60, which is installed in a space, such as a machine room or above a ceiling.

The heat medium heat exchanger 61 is configured to exchange heat between the refrigerant supplied from the outdoor unit 1 and the heat medium. The heat medium heat exchanger 61 may be constituted, for example, by a plate heat exchanger. The indoor unit 2 can perform cooling operation or heating operation by using heat transferred from the refrigerant to the heat medium by the heat medium heat exchanger 61.

The heat medium flow control device 63 is configured to regulate the flow rate of the heat medium supplied to the indoor unit 2. The heat medium flow control device 63 preferably has a mechanism whose opening degree is adjustable to any value. Controlling the heat medium flow control device 63 in such a way as to maintain a constant temperature difference between the third temperature detecting device 51 and the fourth temperature detecting device 52, which are installed in the indoor unit 2, is preferable in that the level of performance is adjusted for indoor load.

Although one heat medium heat exchanger 61 and one indoor unit 2 are connected to the outdoor unit 1 in Embodiment 2 as illustrated in FIG. 7, the configuration is not limited to this. More than one heat medium relay unit 60 and more than one indoor unit 2 may be connected to the outdoor unit 1.

[Liquid Hammer Prevention Control Action in Embodiment 2]

A liquid hammer prevention control action according to Embodiment 2 will not be described here, as it can achieve an effect similar to that of Embodiment 1 by performing, in each operation, the same action as that of Embodiment 1.

Even in an indirect air-conditioning system that does not allow refrigerant to flow in the indoor unit 2 as in Embodiment 2, performing the liquid hammer prevention control action can reduce the amount of refrigerant leakage, for example, in a machine room or above a ceiling. The air-conditioning apparatus 100 can thus provide a higher level of safety.

Figure 8:
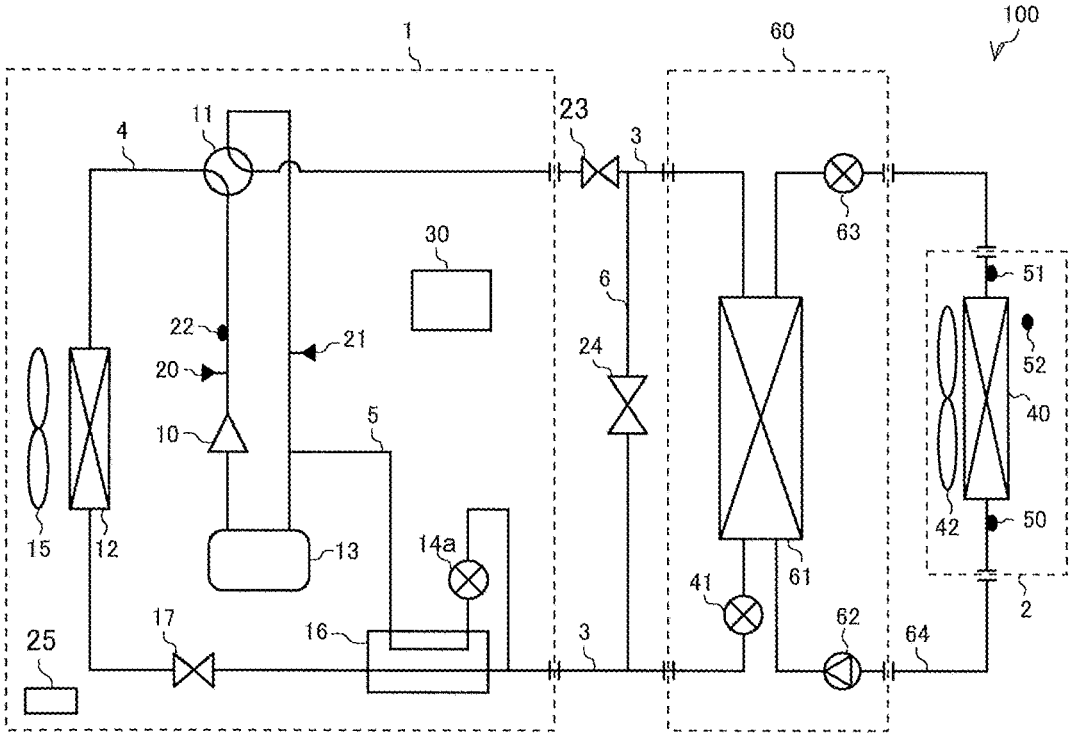
FIG. 8 is a refrigerant circuit diagram illustrating a modification of the air-conditioning apparatus according to Embodiment 2.

FIG. 8 is a refrigerant circuit diagram illustrating a modification of the air-conditioning apparatus 100 according to Embodiment 2.

As illustrated in FIG. 8, a heat-medium-side bypass opening and closing device 24 may be provided parallel to the heat medium relay unit 60. The heat-medium-side bypass opening and closing device 24 is disposed in a heat-medium-side bypass pipe 6 that branches off from the passage between the internal heat exchanger 16 and the expansion device 41 and joins the passage between the shut-off valve 23 and the heat medium heat exchanger 61. The heat-medium-side bypass opening and closing device 24 is configured to shut off the flow of refrigerant in the heat-medium-side bypass pipe 6. The heat-medium-side bypass opening and closing device 24 may be any device capable of shutting off the flow of refrigerant, and may be constituted, for example, by a solenoid valve. Even with the heat-medium-side bypass opening and closing device 24, a similar effect can still be achieved by performing a liquid hammer prevention control action.

Figure 9:
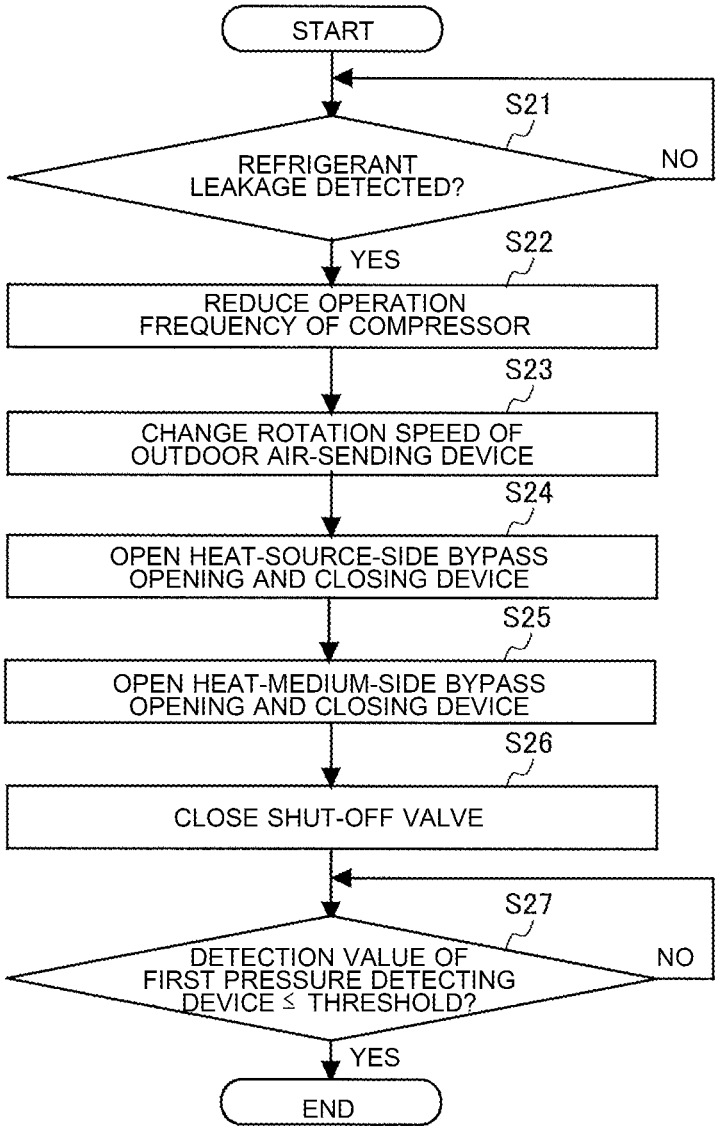
FIG. 9 is a flowchart illustrating details of a refrigerant leakage prevention action in the modification of the air-conditioning apparatus according to Embodiment 2.

FIG. 9 is a flowchart illustrating details of a refrigerant leakage prevention action in the modification of the air-conditioning apparatus 100 according to Embodiment 2.

On the basis of FIG. 9, the refrigerant leakage prevention action in the modification of the air-conditioning apparatus 100 according to Embodiment 2 will be described in detail.

(Step S21)

The controller 30 determines whether the occurrence of refrigerant leakage has been detected. If the controller 30 determines that the occurrence of refrigerant leakage has been detected (YES), the process proceeds to step S22. On the other hand, if the controller 30 determines that the occurrence of refrigerant leakage has not been detected (NO), the operation of step S21 is repeated.

(Step S22)

The controller 30 lowers the operation frequency of the compressor 10. The process then proceeds to step S23.

(Step S23)

The controller 30 changes the rotation speed of the heat-source-side air-sending device 15. The process then proceeds to step S24. Here, the controller 30 increases the rotation speed of the heat-source-side air-sending device 15 in cooling operation, and decreases the rotation speed of the heat-source-side air-sending device 15 in heating operation.

(Step S24)

The controller 30 opens the heat-source-side bypass opening and closing device 14*a*. The process then proceeds to step S25.

(Step S25)

The controller 30 opens the heat-medium-side bypass opening and closing device 24. Opening the heat-medium-side bypass opening and closing device 24 reduces the difference between the pressure on the high-pressure side and the pressure on the low-pressure side. The process then proceeds to step S26.

(Step S26)

The controller 30 closes the shut-off valve 23. The process then proceeds to step S27.

(Step S27)

The controller 30 determines whether the detection value of the first pressure detecting device 20 has reached a preset threshold. If the controller 30 determines that the detection value of the first pressure detecting device 20 has reached the threshold (YES), the process ends. On the other hand, if the controller 30 determines that the detection value of the first pressure detecting device 20 has not reached the threshold (NO), the operation of step S27 is repeated.

Instead of determining whether the detection value of the first pressure detecting device 20 has reached the threshold in step S27, the controller 30 may determine whether the second pressure detecting device 21 has reached a threshold, or may determine whether a predetermined period of time has passed since the start of the operation of step S22.

Note that steps S22 to S25 in FIG. 9 correspond to the liquid hammer prevention control action illustrated in FIG. 4, and steps S26 and S27 in FIG. 9 correspond to the refrigerant leakage prevention action illustrated in FIG. 4.

In step S22, the operation frequency of the compressor 10 is lowered, as described above. If the operation frequency of the compressor 10 is high when the shut-off valve 23 is closed in step S26, the resulting abrupt change in the pressure of the refrigerant circuit causes the occurrence of a liquid hammer phenomenon. The occurrence of a liquid hammer phenomenon may damage the shut-off valve 23. Therefore, the operation frequency of the compressor 10 may be set lower than that in normal cooling operation, so that the pressure of the refrigerant circuit is prevented from becoming too high when the shut-off valve 23 is closed to shut off the flow of refrigerant.

In step S23, the rotation speed of the heat-source-side air-sending device 15 may be set to a maximum rotation speed or a value close to it in cooling operation, and may be set to a minimum rotation speed or a value close to it in heating operation. Increasing the rotation speed of the heat-source-side air-sending device 15 in cooling operation can facilitate condensation of the refrigerant in the heat-source-side heat exchanger 12 and suppress an increase in the discharge pressure of the compressor 10. Also, increasing the rotation speed of the heat-source-side air-sending device 15 in cooling operation increases subcooling, and decreasing the rotation speed of the heat-source-side air-sending device 15 in heating operation decreases superheat. This facilitates accumulation of liquid refrigerant in the outdoor unit 1, and makes it less likely that a liquid hammer phenomenon will occur.

Since the heat-source-side bypass opening and closing device 14*a* is an opening degree adjustable device, the opening degree may be set to a maximum opening degree in step S24. Opening the heat-source-side bypass opening and closing device 14*a* reduces the flow rate of the refrigerant flowing through the shut-off valve 23 and makes it less likely that a liquid hammer phenomenon will occur.

The smaller the difference between the pressure detection value on the high-pressure side and the pressure detection value on the low-pressure side, the better. Therefore, when a determination is made in step S27 as to whether the detection value of the first pressure detecting device 20 has reached a threshold, the threshold may be set to a minimum pressure allowed by the compressor 10 during operation or a value close to the minimum pressure. Similarly, when a determination is made as to whether the detection value of the second pressure detecting device 21 has reached a threshold, the threshold may be set to a maximum pressure allowed by the compressor 10 during operation or a value close to the maximum pressure.

The smaller the difference between the pressure on the high-pressure side and the pressure on the low-pressure side, the less the occurrence of a liquid hammer. However, when the operation frequency of the compressor 10 is controlled to be a predetermined target high-pressure value, the pressure on the high-pressure side is not easily lowered. Therefore, when the operation frequency of the compressor 10 is controlled to be a predetermined target high-pressure value, the process is terminated once the detection value of the second pressure detecting device 21, or the pressure detection value on the low-pressure side, reaches the threshold in step S27 (YES in step S27).

Performing the liquid hammer prevention control action (illustrated in FIG. 9) in cooling operation of the air-conditioning apparatus 100 can lower a high pressure in cooling operation. This reduces a pressure difference during operation of the shut-off valve 23 and makes it less likely that a liquid hammer phenomenon will occur.

Although a procedure of the liquid hammer prevention control action according to Embodiment 2 has been described as illustrated in FIG. 9, the procedure is not limited to this. Even when the sequence of step S22 to step S25 is changed, it is still possible to achieve a similar effect.

The liquid hammer prevention control in heating operation makes the pressure of the load-side heat exchanger 40 in the indoor unit 2 very low. As a result, moisture in the air is cooled and the load-side heat exchanger 40 and the pipe in the indoor unit 2 may be frozen. This may expand pinholes causing refrigerant leakage in the pipe, and may lead to the occurrence of leakage in other areas. Accordingly, the load-side air-sending device 42 is operated at a full speed, or at an airflow rate close to it, to prevent freezing in the indoor unit 2, so that improved safety can be achieved.

The air-conditioning apparatus 100 according to Embodiment 2 includes the refrigerant circuit including the compressor 10, the heat-source-side heat exchanger 12, the expansion device 41, the heat medium heat exchanger 61, and the shut-off valve 23 connected in sequence by pipes to allow refrigerant to flow therethrough; the heat medium circuit including the pump 62, the heat medium heat exchanger 61, the heat medium flow control device 63, and the load-side heat exchanger 40 connected in sequence by pipes to allow a heat medium to flow therethrough; the heat-source-side air-sending device 15 configured to send air to the heat-source-side heat exchanger 12; the leakage detecting unit configured to detect refrigerant leakage; and the controller 30 configured to perform cooling operation. If the leakage detecting unit detects refrigerant leakage during cooling operation, the controller 30 closes the shut-off valve 23 after lowering the operation frequency of the compressor 10 and increasing the rotation speed of the heat-source-side air-sending device 15.

If refrigerant leakage is detected during cooling operation, the air-conditioning apparatus 100 according to Embodiment 2 lowers the operation frequency of the compressor 10, so that the pressure of the refrigerant circuit can be prevented from becoming too high when the shut-off valve 23 is closed to shut off the refrigerant flow. Also, increasing the rotation speed of the heat-source-side air-sending device 15 facilitates condensation of the refrigerant in the heat-source-side heat exchanger 12 and can suppress an increase in the discharge pressure of the compressor 10. This reduces a pressure difference during operation of the shut-off valve 23, makes the occurrence of a liquid hammer phenomenon less likely, and can reduce failure of the shut-off valve 23.

In the diagrams illustrating an exemplary circuit configuration of the air-conditioning apparatus 100 according to Embodiments 1 and 2, the points of connection of the heat-source-side bypass pipe 5, the heat-source-side bypass opening and closing device 14, and the heat-source-side bypass pipe 5 are disposed inside the outdoor unit 1. However, the configuration is not limited to this. That is, a similar effect can be achieved even when the points of connection of the heat-source-side bypass pipe 5, the heat-source-side bypass opening and closing device 14, and the heat-source-side bypass pipe 5 are disposed outside the outdoor unit 1. Although the internal heat exchanger 16 is also disposed inside the outdoor unit 1, the configuration is not limited to this. That is, a similar effect can be achieved as long as the internal heat exchanger 16 is disposed between the heat-source-side heat exchanger 12 and the expansion device 41.

Although the air-conditioning apparatus 100 according to Embodiments 1 and 2 includes one outdoor unit 1 in the example described above, the number of outdoor units 1 is not limited to one. In the event of refrigerant leakage, a plurality of outdoor units 1 are each simply required to perform the refrigerant leakage prevention action defined in Embodiment 1 or 2, so that a similar effect can be achieved.

In the air-conditioning apparatus 100 according to Embodiments 1 and 2, the system formed by connecting a plurality of indoor units 2 is not limited to a system in which all the indoor units 2 connected perform cooling operation or heating operation (i.e., a system that performs cooling only operation or heating only operation), but may be a system in which some indoor units 2 perform cooling operation and other indoor units 2 perform heating operation (i.e., a system that performs a cooling and heating mixed operation. A similar effect can be achieved by simply performing the liquid hammer prevention control action defined in Embodiment 1 or 2.

Although the outdoor unit 1 includes one compressor 10 in the air-conditioning apparatus 100 according to Embodiments 1 and 2, the configuration is not limited to this. The outdoor unit 1 may include two or more compressors 10.

The invention claimed is:

1. An air-conditioning apparatus comprising:

a refrigerant circuit including a compressor, a heat-source-side heat exchanger, an expansion valve, a load-side heat exchanger, and a shut-off valve connected in sequence by pipes to allow refrigerant to flow therethrough;

a heat-source-side air-sending fan configured to send air to the heat-source-side heat exchanger;

a leakage detecting sensor configured to detect refrigerant leakage; and a controller configured to perform cooling operation, wherein the controller is configured to:

responsive to determining that the leakage detecting sensor detects refrigerant leakage during cooling operation;

perform liquid hammer prevention control including to control an operation frequency of the compressor to be lowered and control a rotation speed of the heat-source-side air-sending fan to be increased, and thereafter control the shut-off valve to be closed to prevent refrigerant leakage.

2. The air-conditioning apparatus of claim 1, wherein the refrigerant circuit includes a flow switching valve configured to switch a direction of flow of the refrigerant between cooling operation and heating operation; and the controller is configured to, responsive to determining that the leakage detecting sensor detects refrigerant leakage during heating operation;

perform control to prevent liquid hammer including to lower the operation frequency of the compressor to be non-zero and lower than an operation frequency of a normal heating operation and control the rotation speed of the heat-source-side air-sending fan to be decreased, and thereafter control the shut-off valve to be closed to prevent refrigerant leakage.

3. The air-conditioning apparatus of claim 1, comprising a load-side air-sending fan configured to send air to the load-side heat exchanger, wherein the controller is configured to, responsive to determining that the leakage detecting sensor detects refrigerant leakage during heating operation, in the control to prevent liquid hammer, increase the rotation speed of the load-side air-sending fan before closing the shut-off valve to prevent refrigerant leakage.

4. The air-conditioning apparatus of claim 1, wherein the refrigerant circuit includes a heat-source-side bypass pipe branching off from a passage between the heat-source-side heat exchanger and the expansion valve and joining a passage between the shut-off valve and a suction side of the compressor in cooling operation, and a heat-source-side bypass opening and closing valve disposed in the heat-source-side bypass pipe; and the controller is configured to, responsive to determining that the leakage detecting sensor detects refrigerant leakage during cooling operation, in the control to prevent liquid hammer, open the heat-source-side bypass opening and closing valve before closing the shut-off valve to prevent refrigerant leakage.

5. The air-conditioning apparatus of claim 2, comprising a load-side air-sending fan configured to send air to the load-side heat exchanger, wherein the controller is configured to, responsive to determining that the leakage detecting sensor detects refrigerant leakage during heating operation, in the control to prevent liquid hammer, increase the rotation speed of the load-side air-sending fan before closing the shut-off valve to prevent refrigerant leakage.

6. The air-conditioning apparatus of claim 2, wherein the refrigerant circuit includes a heat-source-side bypass pipe branching off from a passage between the heat-source-side heat exchanger and the expansion valve and joining a passage between the shut-off valve and a suction side of the compressor in cooling operation, and a heat-source-side bypass opening and closing valve disposed in the heat-source-side bypass pipe; and the controller is configured to, responsive to determining that the leakage detecting sensor detects refrigerant leakage during cooling operation, in the control to prevent liquid hammer, open the heat-source-side bypass opening and closing valve before closing the shut-off valve to prevent refrigerant leakage.

7. The air-conditioning apparatus of claim 3, wherein the refrigerant circuit includes a heat-source-side bypass pipe branching off from a passage between the heat-source-side heat exchanger and the expansion valve and joining a passage between the shut-off valve and a suction side of the compressor in cooling operation, and a heat-source-side bypass opening and closing valve disposed in the heat-source-side bypass pipe; and the controller is configured to, responsive to determining that the leakage detecting sensor detects refrigerant leakage during cooling operation, in the control to prevent liquid hammer, open the heat-source-side bypass opening and closing valve before closing the shut-off valve to prevent refrigerant leakage.

8. An air-conditioning apparatus comprising:

a refrigerant circuit including a compressor, a heat-source-side heat exchanger, an expansion valve, a heat medium heat exchanger, and a shut-off valve connected in sequence by pipes to allow refrigerant to flow therethrough;

a heat medium circuit including a pump, the heat medium heat exchanger, a heat medium flow control valve, and a load-side heat exchanger connected in sequence by pipes to allow a heat medium to flow therethrough;

a heat-source-side air-sending fan configured to send air to the heat-source-side heat exchanger;

a leakage detecting sensor configured to detect refrigerant leakage; and a controller configured to perform cooling operation, wherein the controller is configured to:

responsive to determining that the leakage detecting sensor detects refrigerant leakage during cooling operation;

perform liquid hammer prevention control including to control an operation frequency of the compressor to be lowered and control a rotation speed of the heat-source-side air-sending fan to be increased, and thereafter control the shut-off valve to be closed to prevent refrigerant leakage.

9. The air-conditioning apparatus of claim 8, wherein the refrigerant circuit includes a heat-medium-side bypass pipe branching off from a passage between the heat-source-side heat exchanger and the expansion valve and joining a passage between the shut-off valve and the heat medium heat exchanger, and a heat-medium-side bypass opening and closing valve disposed in the heat-medium-side bypass pipe; and the controller is configured to, responsive to determining that the leakage detecting sensor detects refrigerant leakage during cooling operation, in the control to prevent liquid hammer, open the heat-medium-side bypass opening and closing valve before closing the shut-off valve to prevent refrigerant leakage.

10. The air-conditioning apparatus of claim 8, wherein the refrigerant circuit includes a flow switching valve configured to switch a direction of flow of the refrigerant between cooling operation and heating operation; and the controller is configured to, responsive to determining that the leakage detecting sensor detects refrigerant leakage during heating operation;

perform control to prevent liquid hammer including to lower the operation frequency of the compressor and control the rotation speed of the heat-source-side air-sending fan to be decreased, and thereafter control the shut-off valve to be closed to prevent refrigerant leakage.

11. The air-conditioning apparatus of claim 8, comprising a load-side air-sending fan configured to send air to the load-side heat exchanger, wherein the controller is configured to, responsive to determining that the leakage detecting sensor detects refrigerant leakage during heating operation, in the control to prevent liquid hammer, increase the rotation speed of the load-side air-sending fan before closing the shut-off valve to prevent refrigerant leakage.

12. The air-conditioning apparatus of claim 8, wherein the refrigerant circuit includes a heat-source-side bypass pipe branching off from a passage between the heat-source-side heat exchanger and the expansion valve and joining a passage between the shut-off valve and a suction side of the compressor in cooling operation, and a heat-source-side bypass opening and closing valve disposed in the heat-source-side bypass pipe; and the controller is configured to, responsive to determining that the leakage detecting sensor detects refrigerant leakage during cooling operation, in the control to prevent liquid hammer, open the heat-source-side bypass opening and closing valve before closing the shut-off valve to prevent refrigerant leakage.

13. The air-conditioning apparatus of claim 10, wherein the refrigerant circuit includes a heat-medium-side bypass pipe branching off from a passage between the heat-source-side heat exchanger and the expansion valve and joining a passage between the shut-off valve and the heat medium heat exchanger, and a heat-medium-side bypass opening and closing valve disposed in the heat-medium-side bypass pipe; and the controller is configured to, responsive to determining that the leakage detecting sensor detects refrigerant leakage during cooling operation, in the control to prevent liquid hammer, open the heat-medium-side bypass opening and closing valve before closing the shut-off valve to prevent refrigerant leakage.

14. The air-conditioning apparatus of claim 11, wherein the refrigerant circuit includes a heat-medium-side bypass pipe branching off from a passage between the heat-source-side heat exchanger and the expansion valve and joining a passage between the shut-off valve and the heat medium heat exchanger, and a heat-medium-side bypass opening and closing valve disposed in the heat-medium-side bypass pipe; and the controller is configured to, responsive to determining that the leakage detecting sensor detects refrigerant leakage during cooling operation, in the control to prevent liquid hammer, open the heat-medium-side bypass opening and closing valve before closing the shut-off valve to prevent refrigerant leakage.

15. The air-conditioning apparatus of claim 12, wherein the refrigerant circuit includes a heat-medium-side bypass pipe branching off from a passage between the heat-source-side heat exchanger and the expansion valve and joining a passage between the shut-off valve and the heat medium heat exchanger, and a heat-medium-side bypass opening and closing valve disposed in the heat-medium-side bypass pipe; and the controller is configured to, responsive to determining that the leakage detecting sensor detects refrigerant leakage during cooling operation, in the control to prevent liquid hammer, open the heat-medium-side bypass opening and closing valve before closing the shut-off valve to prevent refrigerant leakage.

* * * * *